United States Patent [19]

Willis

[11] Patent Number: 4,792,383

[45] Date of Patent: Dec. 20, 1988

[54] POLYMER COMPOSITIONS AND ALKALINE ZINC ELECTROPLATING BATHS AND PROCESSES

[75] Inventor: William I. Willis, North Royalton, Ohio

[73] Assignee: McGean-Rohco, Inc., Cleveland, Ohio

[21] Appl. No.: 114,098

[22] Filed: Oct. 27, 1987

[51] Int. Cl.[4] ..... C25D 3/22; C25D 3/24; C08L 79/04; C08G 73/06

[52] U.S. Cl. ..... 204/55.3; 204/55.1; 528/405; 528/423

[58] Field of Search ..... 528/405, 423; 204/55.1, 204/55.3

[56] References Cited

U.S. PATENT DOCUMENTS

| | | | |
|---|---|---|---|
| 2,097,630 | 11/1937 | Lutz | 204/50.3 |
| 2,383,798 | 8/1945 | Hull | 204/50.3 |
| 2,791,554 | 5/1957 | Winters et al. | 204/55 |
| 3,411,996 | 11/1968 | Rushmere | 204/55.3 X |
| 3,824,158 | 7/1974 | Rosenberg | 204/55 R |
| 3,849,325 | 11/1974 | Kampe | 252/79.1 |
| 3,869,358 | 3/1975 | Nobel et al. | 204/55 Y |
| 3,871,974 | 3/1975 | Duchene et al. | 204/55 R |
| 3,954,575 | 5/1976 | Yanagida et al. | 204/55 R |
| 3,974,045 | 8/1976 | Takahashi et al. | 204/55 R |
| 4,169,772 | 10/1979 | Lowery et al. | 204/55 R |
| 4,188,271 | 2/1980 | Eckles et al. | 204/55 R |
| 4,397,717 | 8/1983 | Acimovic et al. | 204/55 Y |
| 4,730,022 | 3/1988 | Willis | 528/405 X |

*Primary Examiner*—G. L. Kaplan

*Attorney, Agent, or Firm*—Renner, Otto, Boisselle & Sklar

[57] ABSTRACT

Compositions are described which are useful particularly in improving the electrodeposition of zinc from aqueous alkaline plating baths. In one embodiment, the new composition comprises the reaction product of (A-1) at least one nitrogen-containing heterocyclic compound with (A-2) at least one hydroxyamine;

(A-3) an epihalohydrin, glycerolhalohydrin or mixtures thereof; and (A-4) at least one amino compound containing at least one N—H group to form the desired polymeric composition.

Aqueous alkaline zinc electroplating baths containing the compositions of the invention with or without cyanide present, deposit a bright and lustrous zinc coating on metal.over a wide range of current densities.

53 Claims, No Drawings

POLYMER COMPOSITIONS AND ALKALINE ZINC ELECTROPLATING BATHS AND PROCESSES

TECHNICAL FIELD OF THE INVENTION

This invention relates to new polymeric compositions, and to improvements in the electrodeposition of zinc from aqueous alkaline zinc plating baths. More particularly, the invention relates to new compositions which are particularly suitable as brightener additives for aqueous alkaline zinc electrodepositing baths.

BACKGROUND OF THE INVENTION

Considerable attention has been directed to the development of zinc electroplating baths which will produce zinc deposits of improved quality. Research has been devoted to improving the over-all brightness, the range of allowable current densities, and the ductility of the zinc coatings. Many of the successful aqueous alkaline zinc plating baths contain various quantities of sodium cyanide and various brightener compositions to improve the brightness of the zinc deposits. Although the alkaline cyanide baths generally are less expensive to operate and are particularly effective in plating substrates having recesses (such as cup shapes), the trend has been to develop zinc plating baths requiring lesser amounts of cyanide or no cyanide since the cyanides are toxic. The toxicity of the cyanide materials presents serious problems of disposal, particularly since waste disposal has come under the scrutiny of the federal and state governments resulting in the passage of a number of laws and regulations regarding the disposal of waste materials.

Alkaline zinc plating baths generally are based on a solution of zinc ions and an excess of a base such as sodium hydroxide and water. High pH alkaline zinc baths when used without brightening or addition agents yield deposits which are rough and spongy, and generally unacceptable for most applications. In a number of cases, production experience has demonstrated that alkaline zinc electroplating baths perform better if a small amount, e.g., less than 15 g/l, of cyanide is included in the bath.

Cyanide-free or substantially cyanide-free alkaline zinc plating baths containing various organic additives have been described in the prior art. U.S. Pat. No. 3,849,325 relates to the deposition of a bright zinc coating from an alkaline zinc electroplating bath which contains little or no cyanide. The brightening agent which is incorporated into the bath is obtained by the reaction of a nitrogen-containing heterocyclic compound such as pyridine, pyrazine, quinoline and derivatives thereof, an acyclic amine having at least two functional groups, formaldehyde and an epihalohydrin or a glycerol halohydrin.

Organic additives also have been developed which, when included in the cyanide-free plating baths, do provide electrodeposits of fair quality. Efforts have continued in the art to develop brightener additive compositions which will significantly improve the brightness and ductility of the zinc deposit. In U.S. Pat. No. 3,974,045, a water-soluble polymer additive for alkaline zinc plating baths is described which is prepared by reacting at least one epihalohydrin with at least one nitrogen heterocyclic compound such as the compounds of imidazole, pyrrole, cyclic amines and piperazine in the presence of at least one nitrogen compound such as the compounds of aliphatic amines, hexamethylene tetramine and ammonia. The brightener additive is useful in both cyanide-containing and cyanide-free alkaline zinc plating baths.

U.S. Pat. No. 4,397,717 describes alkaline zinc plating baths containing one or more reaction products obtained by first reacting an epihalohydrin with a heterocyclic nitrogen compound having at least two nitrogen atoms to form an intermediate, and then reacting the intermediate with ammonia, an aliphatic amine, polyamine and/or polyimine. The bath also contains the reaction product of a polyvalent alcohol with epichlorohydrin and a nitrogen-containing heterocyclic compound.

U.S. Pat. No. 4,188,271 describes compositions prepared by reacting formaldehyde with a mixture of one or more piperazines and one additional nitrogen compound such as ammonia or aliphatic, alicyclic compounds containing at least one primary amine group to form an intermediate which is then reacted with an epihalohydrin or glycerol halohydrin. These compositions are intended for use in aqueous alkaline zinc electroplating baths for producing bright metallic zinc deposits.

U.S. Pat. No. 4,169,772 describes acidic zinc plating baths containing a brightener composition obtained by reacting a nitrogen-containing heterocyclic compound with formaldehyde, an epihalohydrin or glycerol halohydrin and at least one amino compound which may be ammonia, an aliphatic amine or an amidine.

SUMMARY OF THE INVENTION

The present invention comprises a polymeric composition comprising the reaction product of (A-1) at least one nitrogen-containing heterocyclic compound with (A-2) at least one hydroxyamine;

(A-3) an epihalohydrin, glycerolhalohydrin or mixtures thereof; and (A-4) at least one amino compound containing at least one N—H group to form the desired polymeric composition.

Aqueous alkaline zinc electroplating baths containing the compositions of the invention, with or without cyanide present, deposit a bright and lustrous zinc coating on metal over a wide range of current densities.

DESCRIPTION OF THE PREFERRED EMBODIMENTS

The compositions of this invention are obtained by the reaction of (A-1) at least one nitrogen-containing heterocyclic compound;

(A-2) at least one hydroxyamine;

(A-3) an epihalohydrin, glycerolhalohydrin or mixtures thereof; and (A-4) at least one amino compound containing at least one N—H group to form the desired polymeric composition.

(A-1): Nitrogen-Containing Heterocyclic Compounds

The nitrogen-containing heterocyclic compounds utilized in the preparation of the polymeric compounds of this invention include heterocyclic compounds containing one, two or three nitrogen atoms. Examples of types of such nitrogen-containing heterocyclic compounds include pyrrole, imidazole, pyrazole, 1,2,3-triazole, 1,2,4-triazole, pyridine, piperidine, piperazine, saturated cyclic amines of the formula

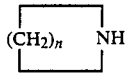

(I)

wherein n is 2–5, and various derivatives of any of these heterocyclic compounds such as derivatives wherein the hydrogen atom of the imino group and/or a ring hydrogen atom are substituted with a hydroxyl, alkyl, amino or acetyl group. Specific examples of useful nitrogen-containing heterocyclic compounds include imidazole, 1-methyl imidazole, 1-ethyl imidazole, 2-methyl imidazole, 1,2-dimethyl imidazole, 1,4-dimethyl imidazole, 1-ethyl imidazole, 1-vinyl imidazole, 4-phenyl imidazole, 1 acetyl imidazole, 4-hydroxy-2-amino imidazole, 5-ethyl-4-hydroxy imidazole, 2,5-dimethyl pyrrole, 1-ethyl pyrrole, 1-acetyl pyrrole, 1-methyl pyrrole, pyrazole, 2-methyl pyrazole, 4-methyl pyrazole, pyridine, 4-hydroxy pyridine, 4-picoline, 3-chloro pyridine, piperidine, 1-amyl piperidine, 2-ethyl piperidine, 3,5-pyrazole dicarboxylic acid, piperazine, N-methyl piperazine, N,N-dimethyl piperazine, 2-methyl piperazine, N,N-diethyl piperazine, 2,5-dimethyl piperazine, and 2 -ethyl piperazine. Examples of saturated cyclic amines containing one nitrogen atom include ethyleneimine, pyrrolidine, N-methyl pyrrolidine, piperidine, 1-methyl piperidine, 2-methyl piperidine, 3-methyl piperidine, 4-methyl piperidine, 2,6-dimethyl piperidine and 3,5-dimethyl piperidine.

(A-2): Hydroxyamines

Any of the above nitrogen-containing heterocyclic compounds or mixtures thereof are reacted with at least one hydroxyamine which is preferably an alkanol amine. Among the alkanol amines which have been found to yield useful products by the reaction sequence of the present invention are monoethanolamine, diethanolamine, triethanolamine, N-methyl diethanolamine, N,N,N',N'-tetrakis-(hydroxyethyl)-ethylenediamine, tris-(hydroxymethyl) amino methane, di-(hydroxy propyl) amine, 2-amino ethanol, 3-dimethyl amino-1-propanol, hydroxy ethyl pyridine, N-hydroxyethyl pyrrolidine, hydroxy ethyl aniline, etc.

In one embodiment, the preferred alkanol amine is diethanolamine.

(A-3): Epihalohydrin or Glycerolhalohydrin

The nitrogen-containing heterocyclic compounds and hydroxy amino compounds are reacted in accordance with the process of the present invention with (A-3) an epihalohydrin, a glycerolhalohydrin, or mixtures thereof to form an intermediate. Generally, this reaction is carried out in aqueous medium.

The epihalohydrins that are useful in the preparation of the intermediates of the invention include those having the formula

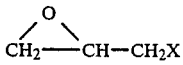

(II)

wherein X is chloro or bromo. Epichlorohydrin is particularly preferred. In lieu of, or in addition to the epihalohydrins, glycerolhalohydrins having the following formula may be utilized.

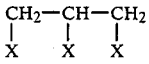

(III)

wherein at least one but not more than two of the X's are hydroxy groups and the remaining X's are chlorine or bromine. Examples of such reactants include, for example, 1,3-dichloro-2-hydroxy propane; 3-chloro-1,2-dihydroxy propane and 2,3-dichloro-1-hydroxy propane.

(A-4): Amino Compound Containing at Least One N—H Group

The amino compounds useful as component (A-4) in the preparation of the polymeric compositions of this invention are amino compounds containing at least one N—H group. In one embodiment, the amino compound may be ammonia, an aliphatic amine or an aliphatic polyamine. The aliphatic amines may be either acyclic or cyclic amines. An example of a cyclic amine which is useful is hexamethylene tetramine. The acyclic aliphatic amines may be either primary amines, secondary amines or tertiary amines. Preferably, the amino compound (A-4) is an aliphatic polyamine, and more specifically, an alkylene polyamine which may have the general formula $$R_2N—(\text{alkylene}—NR)_x\text{alkylene } NR_2$$

wherein x is an integer of from zero to 4, and alkylene may be a straight or branched chain group containing up to about 6 carbon atoms, and each R is independently hydrogen or a lower alkyl group containing up to about 6 carbon atoms, with the proviso that at least one R is hydrogen. Exampls of such alkylene polyamines containing at least one NH group include ethylene diamine, triethylene tetramine, propylene diamine, N-ethyl-ethylene diamine, tripropylene tetramine, tetraethylene pentamine, pentaethylene hexamine, dimethylamino propylamine, diethylamino propylamine, etc.

The amino compound (A-4) also may be an alicyclic amine compound such as a piperazine, a piperidine, etc. Specific examples of such useful cyclic amines include piperazine, 2-methyl piperazine, N-methyl piperazine, piperidine, 2-methyl piperidine, etc. The alicyclic amine compound (A-4) is different from the nitrogen-containing heterocyclic compound (A-1) unless the reactants are reacted in a certain sequence as described below. Thus in such particular reaction sequences reactant (A-4) could be the same as reactant (A-1). Preferably, however, (A-4) is different from (A-1).

The amount of epihalohydrin and/or glycerolhalohydrin included in the mixture may vary over a wide range, but generally, from about 1 to about 5 moles of the epihalohydrin or glycerolhalohydrin are included in the reaction mixture per mol of nitrogen-containing heterocyclic compound. In one preferred embodiment, the nitrogen heterocyclic compound is reacted with an excess of epihalohydrin or glycerolhalohydrin such as from about 2 to about 3 moles of epihalohydrin or glycerolhalohydrin per mole of nitrogen-containing heterocyclic compound.

The amount of hydroxyamine (A-2) included in the mixture in the preparation of the intermediate also may vary over a wide range, but generally, the amount of hydroxyamine included in the mixture will be from about 0.1 to about 2 moles of hydroxyamine per mole of nitrogen-containing heterocyclic compound. Thus, the molar ratio of (A-1):(A-2):(A-3) may be from about 1:0.1:1 to about 1:2:5. In one embodiment, generally less than one mole of the hydroxyamine is used per mole of the nitrogen-containing heterocyclic compound.

The reaction between the nitrogen-containing heterocyclic compound (A-1), the hydroxyamine (A-2) and the epihalohydrin or glycerolhalohydrin (A-3) may be conducted at from room temperature up to, but below, the decomposition temperature of any component of the mixture, or the product. Preferably, however, the reaction is conducted at from room temperature up to but below reflux temperature of the mixture. More generally, the reaction is exothermic and the temperature of the reaction mixture is maintained at a temperature below the reflux temperature of the mixture such as, for example, from about 70°–85° C. The temperature of the reaction mixture may be controlled by the rate of addition of the epihalohydrin or glycerolhalohydrin and further by external cooling.

The intermediate formed by this reaction is not isolated, and after all of the epihalohydrin or glycerolhalohydrin has been added to the nitrogen-containing heterocyclic compound and hydroxyamine, the intermediate is then reacted with at least one amino compound (A-4) to form the desired polymer.

The compositions of the invention are obtained by the reaction of the components identified above as (A-1) through (A-4), and desirable compositions may be obtained by preparing mixtures containing the four components and thereafter effecting the reaction. Alternatively, the compositions of the present invention may be prepared by reacting the components in a stepwise manner.

In one embodiment, the compositions of the invention are obtained by the process which comprises the steps of (A) preparing a mixture comprising
(A-1) at least one nitrogen-containing heterocyclic compound;
(A-2) at least one hydroxyamine; and
(A-4) at least one amino compound containing at least one N—H group; and
(B) reacting said mixture with
(A-3) an epihalohydrin, glycerolhalohydrin or mixtures thereof to form the desired polymeric composition.

In this process, the three components (A-1), (A-2) and (A-4) are generally dissolved in water, and reactant (A-3) is added slowly to the mixture as the reaction proceeds.

In another embodiment, polymeric compositions of the invention are prepared by the process which comprises the steps of (A) preparing an intermediate by reacting
(A-1) at least one nitrogen-containing heterocyclic compound with
(A-2) at least one hydroxyamine; and
(A-3) an epihalohydrin, glycerolhalohydrin or mixtures thereof; and
(B) reacting said intermediate with
(A-4) at least one amino compound containing at least one N—H group to form the desired polymeric composition.

In this embodiment, the amino compound (A-4) may be same as the nitrogen-containing heterocyclic compound (A-1). Generally, however, amino compound (A-4) is different from the heterocyclic compound (A-1).

The amount of amino compound (A-4) used in preparing the polymer compositions of this invention may be varied over a wide range. Generally, the molar ratio of amino compound (A-4) to the nitrogen-containing heterocyclic compound (A-1) is from about 0.1:1 to about 2:1.

In one embodiment of the preparation of the polymeric composition of the present invention, the amino compound (A-4) is added to the intermediate. The reaction which occurs is exothermic. The mixture often reaches a temperature of from about 60°–95° C. during the addition. After all of the amino compound (A-4) is added, the reaction mixture is heated to an elevated temperature, generally at reflux, for a period of from about 1 to 3 hours. The mixture may be heated for longer periods of time, but the reaction generally is completed within 3 hours.

The following examples illustrate the preparation of polymeric compositions of this invention which are particularly useful as brightener additives in aqueous alkaline electroplating baths. Unless otherwise indicated in the following examples, in the claims and elsewhere in this specification, all parts and percentages are by weight and all temperatures are in degrees centigrade.

EXAMPLE 1

A mixture of 13.6 parts of imidazole and 10.5 parts of diethanolamine in 180 parts of water is heated to about 30°–60° C. whereupon 46.3 parts of epichlorohydrin are added slowly with cooling as needed to maintain the mixture at below the reflux temperature. When the addition of the epichlorohydrin is completed, 10.2 parts of 3-dimethylamino propylamine are added as quickly as possible while maintaining the temperature of the mixture at between about 60°–95° C. After all of the dimethylamino propylamine has been added, the mixture is heated at the reflux temperature of the mixture for 2–3 hours. The resulting liquid is allowed to cool to room temperature and is recovered as an aqueous solution of the desired product.

EXAMPLES 2 TO 9

The procedure used for the preparation of these polymers is generally the same as that utilized in the preparation of the polymer of Example 1.

TABLE

| Example | Components | Parts/Wt. |
|---|---|---|
| 2 | 2-methylimidazole | 16.4 |
| | diethanolamine | 10.5 |
| | water | 180.0 |
| | epichlorohydrin | 55.6 |
| | 3-dimethylamino propylamine | 15.3 |
| 3 | imidazole | 13.6 |
| | triethanolamine | 22.4 |
| | water | 180.0 |
| | epichlorohydrin | 64.8 |
| | 3-dimethylamino propylamine | 15.3 |
| 4 | imidazole | 13.6 |
| | 3-dimethylamino-1-propanol | 10.3 |
| | water | 180.0 |
| | epichlorohydrin | 55.6 |
| | 3-dimethylamino propylamine | 10.2 |
| 5 | imidazole | 13.6 |
| | diethanolamine | 15.7 |
| | water | 180.0 |
| | epichlorohydrin | 55.6 |
| | piperazine | 8.6 |
| 6 | piperazine | 17.2 |
| | diethanolamine | 15.7 |
| | water | 180.0 |

TABLE-continued

| Example | Components | Parts/Wt. |
|---|---|---|
| | epichlorohydrin | 55.6 |
| | 3-dimethylamino propylamine | 10.2 |
| 7 | pyrazole | 6.8 |
| | diethanolamine | 5.2 |
| | water | 90.0 |
| | epichlorohydrin | 24.0 |
| | 3-dimethylamino propylamine | 5.1 |
| 8 | imidazole | 13.6 |
| | 2-aminoethanol | 9.1 |
| | water | 180.0 |
| | epichlorohydrin | 55.6 |
| | ethylene diamine | 6.0 |
| 9 | imidazole | 13.6 |
| | 2-aminoethanol | 9.1 |
| | water | 180.0 |
| | epibromohydrin | 62.0 |
| | ethylene diamine | 6.0 |

EXAMPLE 10

A solution of 13.6 gms. of imidazole, 10.2 gms. of 3-dimethylaminopropylamine and 10.5 gms. of diethanolamine in 180 ml. of water is prepared and warmed to about 40° C. The mixture is stirred, and 46.3 gms. of epichlorohydrin are added dropwise with cooling as needed to prevent relux. After the epichlorohydrin addition is completed, the mixture is heated at reflux for two hours. The mixture is then cooled and the product is recovered as an aqueous solution.

The polymeric compositions of the invention described above and which are exemplified in Examples 1–10 are useful particularly as brightening additive compositions for aqueous alkaline zinc electroplating baths. In one embodiment, additive concentrates of the polymeric compositions are prepared, and the concentrates are added to the plating bath as desired. Concentrates containing from about 3% to 30% by weight of the polymer in water are satisfactory.

The amount of polymeric composition added to alkaline zinc electroplating baths is an amount which will be effective in producing a bright, lustrous and generally level deposit of zinc. Depending on the particular plating bath and the nature of the other compounds contained in the bath, the effective brightening amount of the compositions of the invention may range from about 0.01 to as much as 15–20 grams per liter of bath. For example, cyanide-containing baths may contain from about 0.01 to about 1.0 gram of polymeric composition per liter of bath, and alkaline non-cyanide baths may contain from about 1.0 to about 20.0 grams of polymer per liter of bath.

The efficacy of the zinc electroplating baths containing the compositions of the invention may be improved further by including various other materials in the plating bath, and the nature of such materials generally will depend upon whether the plating bath is an alkaline cyanide bath or an alkaline non-cyanide bath. In one embodiment, the compositions of the invention are added to cyanide or non-cyanide baths and more preferably to non-cyanide zinc electroplating baths. The cyanide zinc electroplating baths generally contain less than about 40 g/l of cyanide ion or less than about 60 g/l of sodium cyanide.

Alkaline zinc electroplating baths are prepared from a zinc source and an alkaline material. Sources of zinc ions for aqueous alkaline baths can be alkaline metal zincate such as sodium zincate or potassium zincate. Other sources of zinc ions include zinc oxide, zinc sulfate, zinc acetate, etc. The alkaline material used to form the alkaline baths usually is an alkali metal hydroxide such as sodium hydroxide or potassium hydroxide. When cyanide ion is present, the source of the cyanide can be zinc cyanide, potassium cyanide, sodium cyanide or mixtures of any two or all three of such cyanides. The alkaline zinc plating baths generally will contain from about 4 to 50 grams per liter of zinc ions, from about 60 to 100 grams per liter or more of a base such as sodium hydroxide, and when present, up to about 20 grams per liter of cyanide ion. The pH of the alkaline zinc bath generally will be in the range of from about 10 to about 14, generally above 12, and the pH of the bath can be adjusted by the addition of a base such as sodium hydroxide.

The plating baths of the invention such as those illustrated below will deposit a bright, level and ductile zinc deposit on substrates at conventional temperatures such as about 20° C. to about 60° C. and conventional current densities up to 200 amps per square foot as determined by Hull Cell evaluation. Generally about 25–50 amperes per square foot are used.

The plating baths of the invention may be operated on a continuous or intermittent basis, and from time to time, the components of the bath may have to be replenished. The various components may be added singularly as required or may be added in combination. The amounts of the various compositions to be added to the plating baths may be varied over a wide range depending on the nature and performance of the zinc plating bath to which the composition is added. Such amounts can be determined readily by those skilled in the art.

The alkaline zinc electroplating baths containing the compositions of the invention may be utilized to produce bright zinc deposits on all types of metals and alloys, for example, on iron, zinc die cast, copper and brass. The electroplating baths may be employed in all types of industrial zinc plating processes including still plating baths, high-speed plating baths or strip or wire plating, and in barrel plating.

Inner salts of quaternized pyridine carboxylic acids are useful supplementary brighteners which can be added to the alkaline zinc plating baths of the present invention. The salts may be represented by the general formula (IV)

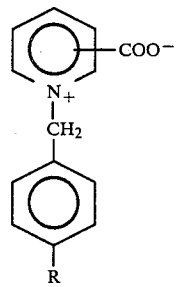

wherein R is hydrogen or

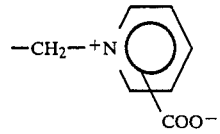

The inner salts may be prepared by quaternizing a pyridine carboxylic acid. The quaternizing agents generally are benzyl halide and substituted benzyl halides. The inner salts also may exist as dimers or higher condensed forms. Preferred examples of inner salts include 1-benzyl pyridinium-3-carboxylate, 1-benzyl pyridinium-4-carboxylate, p-xylyl bis(pyridinium-3-carboxylate), and 1-benzyl pyridium-3,5-dicarboxylate.

The preparation of the inner salts is represented by the following example. Nicotinic acid (1 mole, 123 parts) is reacted with 1 mole of benzyl chloride (126 parts) in 400 parts of water. Sufficient sodium hydroxide is added to the reaction mixture to provide a pH of 6.0 to 6.5. The mixture is refluxed for 3 hours, cooled, and diluted to give a 10% by weight solution of the inner salt.

The incorporation of the inner salts as represented by Formula IV in the baths of the present invention containing the above-described polymer compositions results in an increase in deposit brightness and bright range. Generally, from about 0.01 to about 5 g/l or higher, and more preferably from about 0.02 to about 1 g/l of the inner salt is included in the plating baths.

The bright and lustrous deposits produced by the aqueous alkaline zinc plating baths containing the polymeric compositions of the invention may be improved further if the bath also contains at least one aromatic carbonyl-containing compound which acts as a supplementary brightener imparting optimum levelling action over a wider plating range. The following compounds illustrate the types of aromatic carbonyl-containing compounds which are useful as brighteners in the plating baths of the invention, and these carbonyl compounds include aldehydes, ketones and carboxylic acids and salts: ortho-chlorobenzaldehyde, para-chlorobenzaldehyde, ortho-hydroxybenzaldehyde, aminobenzaldehyde, veratraldehyde, 3,4,5,6-tetrahydrobenzaldehyde, benzaldehyde, vanillin, hydroxybenzaldehyde, anisic aldehyde, benzoic acid, sodium benzoate, sodium salicylate, and 3-pyridine carboxylic acid (nicotinic acid). Mixtures of one or more of the aldehydes with one or more ketones also are useful. The aldehyde brighteners generally are added to the electroplating bath as a bisulfite addition product. When employed in the baths of the invention, the carbonyl-containing brighteners may be included in an amount of from about 0.02 to about 5 g/l or higher and preferably from about 0.03 to 0.5 g/l of bath.

The properties of the zinc deposit from the aqueous alkaline baths of the invention further may be enhanced by including in the baths, other additives conventionally used in such baths. Examples of useful additives include polyvinyl alcohols, manganous sulfate, nickel sulfate and other amine polymers such as those obtained by reacting ammonia with an aldehyde such as formaldehyde.

Other conventional brightening agents such as gelatin, peptone, 3-substituted-N-alkyl pyridium halides and quaternary aliphatic amines also can be utilized in the plating baths of the invention. When used, these brightening agents will be incorporated into the bath in amounts ranging from about 0.005 to about 5 grams per liter of bath. Other examples include water-soluble products made by reacting an amine containing recurring tertiary and/or quaternary amine groups with an epihalohydrin as described in U.S. Pat. No. 3,869,358, and the reaction products of a nitrogen-containing heterocyclic compound such as pyridine, an acyclic amine having at least two functional groups, formaldehyde and an epihalohydrin or glycerol halohydrin as described in U.S. Pat. No. 3,849,325.

Electroplating baths containing polymer compositions of the invention also may contain organic polymers such as polyvinyl alcohol and polyethyleneimine. The polyvinyl alcohol may be modified by forming partial esters by condensation with ethylene oxide or glycidol. Polyvinyl alcohols prepared by hydrolysis of polyvinyl acetate are also useful in the plating baths of the present invention. The polyvinyl alcohols prepared by hydrolysis of the corresponding acetates may have molecular weights of from about 5000 to about 20,000.

In plating baths containing cyanide, particularly good results are obtained when the polymer composition of the invention is used in combination with an aqueous reaction product of ammonia and an epihalohydrin. Such products are described in, for example, U.S. Pat. No. 2,791,554 (Winters), and the disclosure of said patent is hereby incorporated by reference.

The plating baths (and concentrates) of the invention also may contain metal-sequestering agents. Preferred sequestering agents include Rochelle Salt (sodium potassium tartrate), sodium glucoheptonate and sorbitol. These may be present in the baths in amounts of from about 1 to about 15 g/l.

In one embodiment of the invention, additive concentrates of the polymeric compositions of the invention in water are prepared, and these concentrates are added to the bath containing zinc ions, alkali and optionally cyanide ions. For example, additive concentrates useful for preparing alkaline zinc plating baths can be prepared comprising water and from about 3 to about 30% of the polymeric compositions of the invention. In one preferred embodiment of the invention, the additive concentrate will contain water, the polymeric composition, and the inner salt (IV), the weight ratio of polymer to inner salt in the concentrate being in the range of 0.1:1 to 1:0.1. Plating baths can be prepared from such concentrates or the concentrates can be used to replenish working baths. The concentration and proportion of the polymer and inner salt added to water to form the additive concentrate are sufficient to balance the disappearance of these materials from the working bath due to dragout and electrolysis. For alkaline non-cyanide zinc baths, the maintenance additive concentrates contain the polymer and the inner salts in the ratio from about 1:0 to about 1:0.1 and in a concentration of from about 100 to about 900 g/l of polymer reaction product. For maintaining zinc baths containing cyanide, the polymer and inner salts are present in the ratio of from about 0.1:10 to about 1:1 and in a concentration from about 2.0 to about 60 g/l of polymer reaction product. Other optional additives are added either singly or combined to the above additive concentrates or to a second additive concentrate in water.

The following examples, except those identified as control examples, illustrate the aqueous alkaline zinc plating baths of the invention and the utility of the baths as determined in standard Hull cells.

| Test Bath No. 1 (Cyanide-Free) | |
|---|---|
| Zinc metal as sodium zincate | 7.5 g/l |
| Sodium hydroxide | 75.0 g/l |

A plating test is conducted in a 267 ml. Hull cell at 70°-75° F. (21°-24° C.) at an operating current of 2 amps for 4 to 5 minutes. Zinc is deposited on a steel Hull cell panel, and the resulting zinc deposit is black and non-adherent.

| Test Bath No. 2 (Low Cyanide) | |
|---|---|
| Zinc metal as sodium zincate | 13.5 g/l |
| Sodium cyanide | 30 g/l |
| Sodium hydroxide | 75 g/l |
| Sodium carbonate | 25 g/l |

A plating test is conducted on this bath as described in Example Test Bath No. 1 except that the operating current is 1 amp for 10 minutes. The resulting zinc deposit has a mostly dull white-grey appearance.

EXAMPLE A

To Test Bath No. 1 there is added 1.5 cc of the product of Example 2. The plating test is conducted as in Test Bath No. 1, and the resulting Hull cell panel has a shiny deposit obscured by a white haze.

EXAMPLE B

To the bath of Example A is added 1 cc of a 1% anisic aldehyde solution. A plating test is conducted on this bath as described in Test Bath No. 1 and the resulting panel is bright from zero to about 80 ASF.

EXAMPLE C

To Test Bath No. 1 there is added 1 cc of the product of Example 3. A plating test conducted as in Test Bath No. 1 produces a Hull cell panel which is bright from zero to about 80 ASF.

EXAMPLE D

To Test Bath No. 1 there is added 2 cc of the product of Example 8. A plating test is conducted on this bath, and the plating panel is reflective but covered with a dull haze.

EXAMPLE E

To the bath of Example D there is added 1 cc of a 1% veratraldehyde solution. A plating test is conducted, and the resulting Hull cell is bright from zero to about 80 ASF.

EXAMPLE F

To Test Bath No. 2 there is added 0.6 cc of a 10% solution of the product of Example 3. A plating test is conducted, and the resulting Hull cell panel has a reflective hazy deposit.

EXAMPLE G

To the bath of Example F there is added 0.2 grams of 1-benzyl pyridinium 3-carboxylate. A plating test is conducted and the plated panel is full bright above 6 ASF with streaking below 6 ASF.

EXAMPLE CONTROL-1

To Test Bath No. 2 there is added 0.2 grams of 1-benzyl pyridinium 3-carboxylate. A plating test is conducted and the plating panel is dull below 6 ASF and bright but hazy about 6 ASF.

EXAMPLE H

To the bath of Example Control-1 there is added 0.6 cc of a 10% solution of the product of Example 8. A plating test is conducted, and the resulting panel is spangled below 1 ASF with a significant increase in brightness overall compared to the panel of Example Control-1.

EXAMPLE CONTROL-2

To Test Bath No. 2 there is added 0.2 grams of 1-benzyl pyridinium 3-carboxylate and 0.6 cc of a 10% solution of the aqueous reaction product between ammonia and epichlorohydrin. A plating test is conducted, and the resulting Hull cell panel is bright from about zero to 40 ASF and hazy above 40 ASF.

EXAMPLE I

To the bath of Example Control-2 there is added 1 cc of a 10% solution of the product of Example E. A plating test is conducted, and on the plated panel, a significant increase in brightness is obtained above 24 ASF eliminating the haze observed on the panel from Example Control-2.

EXAMPLE J

To Test Bath No. 2 there is added 0.6 cc of a 25% solution of 1-benzyl pyridinium 3-carboxylate and 0.6 cc of a 10% solution of the product of Example 1. A plating test is conducted, and the Hull cell panels are bright with white streaking from zero to 4 ASF and bright above 4 ASF.

The components of the plating baths can be replenished by adding the various compositions individually or in combinations, generally as additives concentrates. Additive concentrates contain one or more additives dissolved in a solvent such as water, alcohol, or water-alcohol mixtures. Generally the additive concentrates will contain as much as 40 to 50% by weight, more often about 3 to about 30% by weight of the polymeric composition of the invention and one or more other additives as described above.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A polymeric composition which comprises the reaction product of (A-1) at least one nitrogen-containing heterocyclic compound;

(A-2) at least on alkanolamine (A-3) an epihalohydrin, glycerolhalohydrin or mixtures thereof; and (A-4) at least one amino compound containing at least one N—H group.

2. The polymeric composition of claim 1 wherein the nitrogen-containing heterocyclic compound (A-1) is a triazole, imadzole, pyrazole, pyrrole, pyridine, piperazine, or saturated cyclic amine.

3. The polymeric composition of claim 1 wherein the nitrogen-containing heterocylic compound (A-1) is an imidazole.

4. The polymeric composition of claim 1 wherein (A-3) is epichlorohydrin.

5. The polymeric composition of claim 1 wherein the amino compound (A-4) is ammonia, an aliphatic amine or a polyamine.

6. The polymeric composition of claim 1 wherein the amino compound (A-4) is an aliphatic polyamine.

7. The polymeric composition of claim 1 wherein the amino compound (A-4) is an alicyclic amine containing at least two nitrogen atoms.

8. The polymeric composition of claim 1 wherein the molar ratio of (A-3) to (A-1) is from about 1:1 to about 5:1.

9. The polymeric composition of claim 1 wherein the molar ratio of amine compound (A-4) to the nitrogen-containing heterocyclic compound (A-1) is from about 0.1:1 to about 2:1.

10. An aqueous alkaline electroplating bath suitable for producing bright metallic zinc deposits comprising a source of zinc ions and from about 0.01 to about 20 grams per liter of bath, of the polymeric composition of claim 1.

11. A method of electrodepositing a zinc coating on a metal substrate which comprises electroplating said substrate with a zinc plating bath of claim 10.

12. An additive concentrate for alkaline zinc plating baths comprising water and from about 3% to about 30% by weight of the polymeric composition of claim 1.

13. An additive concentrate for alkaline zinc plating baths prepared by mixing the polymeric composition of claim 1, at least one inner salt of a quaternized pyridine carboxylic acid and water, the weight ratio of polymer to inner salt being in the range of from about 1:0.1 to about 0.1:1.

14. The additive concentrate of claim 13 containing from about 3% to about 30% by weight of the polymeric composition.

15. A polymeric composition prepared by the process which comprises the steps of (A) preparing a mixture comprising (A-1) at least one nitrogen-containing heterocyclic compound;

(A-2) at least one alkanolamine; and (A-4) at least one amino compound containing at least one N—H group; and (B) reacting said mixture with (A-3) and epihalohydrin, glycerolhalohydrin or mixtures thereof to form the desired polymeric composition.

16. The polymeric composition of claim 15 wherein the nitrogen-containing heterocyclic compound (A-1) is a triazole, imidazole, pyrazole, pyrrole, pyridine, piperazine, or saturated cyclic amine.

17. The polymeric composition of claim 15 wherein the nitrogen-containing heterocyclic compound (A-1) is an imidazole.

18. The polymeric composition of claim 15 wherein (A-3) is epichlorohydrin.

19. The polymeric composition of claim 15 wherein the amino compound (A-4) is ammonia, an aliphatic amine or a polyamine.

20. The polymeric composition of claim 15 wherein the amino compound (A-4) is an aliphatic polyamine.

21. A polymeric composition prepared by the process which comprises the steps of (A) preparing an intermediate by reacting (A-1) at least one nitrogen-containing heterocyclic compound with (A-2) at least one alkanolamine, and (A-3) an epihalohydrin, glycerolhalohydrin or mixtures thereof, and (B) reacting said intermediate with (A-4) at least one amino compound containing at least one N—H group to form the desired polymeric composition.

22. The polymeric composition of claim 21 wherein the nitrogen-containing heterocylic compound (A-1) is a triazole, imidazole, pyrazole, pyrrole, pyridine, piperazine, or saturated cyclic amine.

23. The polymeric composition of claim 21 wherein the nitrogen-containing heterocyclic compound (A-1) is an imidazole.

24. The polymeric composition of claim 21 wherein (A-3) is epichlorohydrin.

25. The polymeric composition of claim 21 wherein the amino compound (A-4) is ammonia, an aliphatic amine or a polyamine.

26. The polymeric composition of claim 21 wherein the amino compound (A-4) is an aliphatic polyamine.

27. The polymeric composition of claim 21 wherein the amino compound (A-4) is an alicyclic amine containing at least two nitrogen atoms.

28. The polymeric composition of claim 21 wherein the molar ratio of (A-3) to (A-1) is from about 1:1 to about 5:1.

29. The polymeric composition of claim 21 wherein the molar ratio of amino compound (A-4) to the nitrogen-containing heterocyclic compound (A-1) is from about 0.1:1 to about 2:1.

30. An aqueous alkaline electroplating bath suitable for producing bright metallic zinc deposits comprising a source of zine ions and from about 0.01 to about 20 grams per liter of bath, of the polymeric composition of claim 21.

31. The plating bath of claim 30 to which is added at least one inner salt of a quaternized pyridine carboxylic acid of the formula

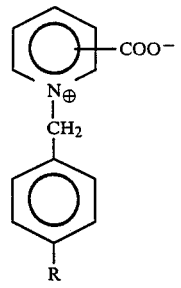

wherein R is hydrogen or

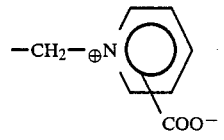

32. The plating bath of claim 30 also containing up to about 40 g/l of cyanide ion.

33. The plating bath of claim 30 also containing at least one aromatic carbonyl compound.

34. The plating bath of claim 30 also containing cyanide ion and an effective amount of a nitrogen containing compound obtained by reacting ammonia, an aliphatic amine containing at least one primary amino group, or mixtures thereof with one or more epihalohydrin, glycerolhalohydrin or mixtures thereof.

35. The plating bath of claim 30 containing less than about 20 g/l of cyanide ions.

36. A polymeric composition prepared by the process which comprises the steps of (A) preparing an intermediate by reacting (A-1) imidazole or an alkyl-substituted imidazole with (A-2) at least one alkanolamine, and (A-3) an epihalohydrin in a mole ratio of from about 1:0.1:1 to about 1:2:5

(B) reacting said intermediate with (A-4) ammonia, an aliphatic amine or polyamine containing at least one N—H group to form the desired polymeric compound.

37. The composition of claim 36 wherein the epihalohydrin (A-3) is epichlorohydrin.

38. The composition of claim 36 wherein (A-1) is imidazole.

39. The composition of claim 36 wherein (A-4) is an aliphatic polyamine.

40. The composition of claim 36 wherein (A-4) is an aliphatic diamine.

41. The composition of claim 36 wherein the reactions in steps (A) and (B) are conducted in the presence of water.

42. The composition of claim 36 wherein the reaction in step (B) is conducted at an elevated temperature up to the reflux temperature of the mixture.

43. The composition of claim 36 wherein the epihalohydrin (A-3) is added ot a mixture of (A-1) and (A-2).

44. An aqueous alkaline electroplating bath suitable for producing bright metallic zinc deposits comprising a source of zinc ions and from about about 0.01 to about 20 grams per liter of bath, of the composition of claim 36.

45. The plating bath of claim 44 to which is added at least one inner salt of a quaternized pyridine carboxylic acid of the formula

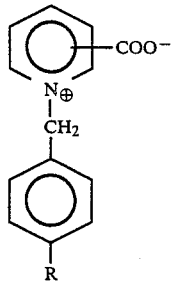

wherein R is hydrogen or

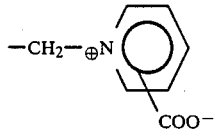

46. The plating bath of claim 44 containing less than about 40 g/l of cyanide ion.

47. An additive concentrate for alkaline zinc plating baths comprising water and from about 3% to about 30% by weight of the polymeric composition of claim 36.

48. An additive concentrate for alkaline zinc plating baths prepared by mixing the polymeric composition of claim 36, at least one inner salt of a quaternized pyridine carboxylic acid and water, the weight ratio of polymer to inner salt being in the range of from about 1:01.1 to about 0.1:1.

49. The additive concentrate of claim 48 containing from about 3% to about 30% by weight of the polymeric composition.

50. A polymeric composition prepared by the process which comprises the steps of (A) preparing an intermediate by reacting (A-1) imidazole with (A-2) an ethanolamine, and (A-3) epichlorohydrin in the presence of water, the molar ratio of imidazole to ethanolamine to epichlorohydrin being within the range of from about 1:0.1:1 to about 1:2:5, and (B) reacting said intermediate with an aliphatic diamine, the molar ratio of aliphatic diamine to imidazole being from about 0.1:1 to about 2:1.

51. An aqueous alkaline electroplating bath suitable for producing bright metallic zinc deposits comprising a source of zinc ions and from about 0.01 to about 20 grams per liter of bath, of the composition of claim 50.

52. The plating bath of claim 51 to which is added at least one inner salt of a quaternized pyridine carboxylic acid of the formula

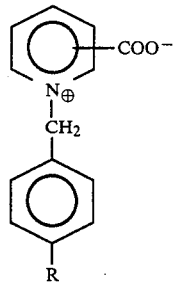

wherein R is hydrogen or

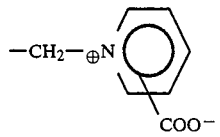

53. The plating bath of claim 51 containing less than about 40 g/l of cyanide ion.

* * * * *